US011591747B2

(12) United States Patent
Suzuki et al.

(10) Patent No.: US 11,591,747 B2
(45) Date of Patent: Feb. 28, 2023

(54) TREATMENT AGENT FOR ELASTIC FIBER

(71) Applicant: TAKEMOTO OIL & FAT CO., LTD., Gamagoori (JP)

(72) Inventors: Katsuya Suzuki, Shiga (JP); Toshihiro Tanaka, Shiga (JP); Kazuki Naeshiro, Shiga (JP); Keiichiro Oshima, Aichi (JP); Yasunobu Arakawa, Aichi (JP)

(73) Assignee: Takemoto Oil & Fat Co., Ltd., Aichi (JP)

( * ) Notice: Subject to any disclaimer, the term of this patent is extended or adjusted under 35 U.S.C. 154(b) by 0 days.

(21) Appl. No.: 17/770,209

(22) PCT Filed: Oct. 20, 2020

(86) PCT No.: PCT/JP2020/039340
§ 371 (c)(1),
(2) Date: Apr. 19, 2022

(87) PCT Pub. No.: WO2021/079863
PCT Pub. Date: Apr. 29, 2021

(65) Prior Publication Data

US 2022/0356641 A1 Nov. 10, 2022

(30) Foreign Application Priority Data

Oct. 21, 2019 (JP) ..... JP2019-192073

(51) Int. Cl.

| | |
|---|---|
| ***D06M 15/233*** | (2006.01) |
| ***D01F 11/08*** | (2006.01) |
| ***D06M 13/02*** | (2006.01) |
| ***D06M 15/227*** | (2006.01) |
| ***D06M 101/38*** | (2006.01) |

(52) U.S. Cl.
CPC ..... *D06M 15/233* (2013.01); *D01F 11/08* (2013.01); *D06M 13/02* (2013.01); *D06M 15/227* (2013.01); *D06M 2101/38* (2013.01); *D06M 2200/35* (2013.01); *D10B 2331/10* (2013.01)

(58) Field of Classification Search
CPC .. D06M 13/02; D06M 15/227; D06M 15/233; D06M 2101/38; D06M 2200/35; D01F 11/08; D10B 2331/10
See application file for complete search history.

(56) References Cited

U.S. PATENT DOCUMENTS

| | | | | |
|---|---|---|---|---|
| 10,329,418 | B2 * | 6/2019 | Gu | C08L 53/025 |
| 2005/0266192 | A1 * | 12/2005 | Yoneda | D06M 15/568 428/36.4 |
| 2012/0004352 | A1 | 1/2012 | Arakawa et al. | |
| 2014/0286887 | A1 * | 9/2014 | Sandler | A61K 8/31 424/70.121 |
| 2016/0108237 | A1 | 4/2016 | Chung et al. | |
| 2020/0056035 | A1 * | 2/2020 | de Groot | H01B 7/282 |
| 2022/0220642 | A1 * | 7/2022 | Suzuki | D01F 6/70 |

FOREIGN PATENT DOCUMENTS

| | | |
|---|---|---|
| JP | 5-086159 | 4/1993 |
| JP | 5-086160 | 4/1993 |
| JP | 5-117975 | 5/1993 |
| JP | 2002-035029 | 2/2002 |
| JP | 2005-206573 | 8/2005 |
| JP | 2010-168717 | 8/2010 |
| JP | 2012-031551 | 2/2012 |
| JP | 2015-193953 | 11/2015 |
| JP | 2016-524656 | 8/2016 |
| JP | 2017-110319 | 6/2017 |
| JP | 6480072 B | 3/2019 |
| JP | 6549340 B | 7/2019 |
| JP | 2019-178241 | 10/2019 |
| JP | 2020-193399 | 12/2020 |
| WO | 2016/143499 | 9/2016 |
| WO | 2019/163585 | 8/2019 |
| WO | 2020/240429 | 12/2020 |

OTHER PUBLICATIONS

International Search Report issued in International Application No. PCT/JP2020/039340, dated Jan. 19, 2021, 5 pages w/translation.
Written Opinion issued in International Application No. PCT/JP2020/039340, dated Jan. 19, 2021, 3 pages.
First Office Action issued in corresponding Chinese Patent Application No. 202080073607.6, dated Aug. 17, 2022, 12 pages w/translation.

* cited by examiner

*Primary Examiner* — Anthony J Green
(74) *Attorney, Agent, or Firm* — Hamre, Schumann, Mueller & Larson, P.C.

(57) ABSTRACT

Provided is an elastic fiber treatment agent, containing; a hydrocarbon resin (A); and a hydrocarbon oil (B). The hydrocarbon resin (A) contains a polymer having a structural unit, as a main structural unit, derived from at least one monomer selected from aromatic olefin and aliphatic diolefin, the polymer being partially hydrogenated or fully hydrogenated. It is preferred that the hydrocarbon resin (A) contains a polymer having a structural unit derived from aromatic olefin as a monomer, the polymer being partially hydrogenated or fully hydrogenated, and the aromatic olefin is at least one selected from indene and methylstyrene. Thus, the elastic fiber treatment agent of the present invention imparts excellent unraveling properties to elastic fibers and has excellent adhesiveness to hot melt adhesives, enables the production of stretchable sheets exhibiting good adhesiveness even when processed at a high draft ratio, and is suitable for obtaining soft feel sanitary products.

9 Claims, 2 Drawing Sheets

TREATMENT AGENT FOR ELASTIC FIBER

TECHNICAL FIELD

The present invention relates to an elastic fiber treatment agent that improves the unraveling properties of elastic fibers and has excellent adhesiveness to hot melt adhesives.

BACKGROUND ART

Elastic fibers have been used for stretch clothing including legwear, innerwear, and sportswear because of their high stretch characteristics. A large amount of elastic fibers are used particularly in sanitary products (sanitary materials) such as disposable diapers and sanitary napkins.

Disposable sanitary products such as disposable diapers and sanitary napkins need to be stretchable to give a comfortable fit to wearers. Specifically, disposable diapers have been devised in various ways to make the waist, legs, torso, and other parts stretchable. Woven fabrics having stretchability (stretch fabrics) may be used for disposable products but are costly for this usage. Generally, yarn-shaped or band-shaped stretchable members are bonded in an elongated state to non-stretchable members such as non-woven fabrics or plastic films to make the non-stretchable members stretchable, thereby forming members called stretchable sheets or gathers (for example, Patent Document 1). Specifically, rubber bands or polyurethane elastic fiber yarns are used as members to be bonded to non-stretchable members to impart stretchability to the non-stretchable members, and hot melt adhesives are used for bonding.

Patent Document 2 discloses various additives to be used in polyurethane elastic fibers to improve hot melt adhesiveness.

Patent Document 3 discloses an oil agent to achieve both of unraveling properties of polyurethane elastic yarns and hot melt adhesiveness.

PRIOR ART DOCUMENTS

Patent Documents

Patent Document 1: JP 2002-035029 A
Patent Document 2: JP 2010-168717 A
Patent Document 3: WO 2016/143499

DISCLOSURE OF INVENTION

Problem to be Solved by the Invention

When conventional elastic fibers for imparting stretchability, such as those disclosed in Patent Document 1, are bonded to a non-stretchable member while being stretched at a high draft ratio, the resistance of the stretched elastic fibers increases, and yarns sometimes get pulled out. If a larger amount of a hot melt adhesive is used to avoid this, the finish becomes hard in return for reducing yarn pull-out, and the stretchability as products sometimes results in unsatisfactory.

Improving the hot melt adhesiveness with use of additives, as described in Patent Document 2, may deteriorate the unraveling properties of elastic fibers, and yarn breakage is more likely to occur during production of stretchable members.

There is still room for improvement in the hot melt adhesiveness in Patent Document 3.

The present invention solves the above conventional problems and provides an elastic fiber treatment agent that imparts excellent unraveling properties to elastic fibers and has excellent adhesiveness to hot melt adhesives, that enables the production of stretchable sheets exhibiting good adhesiveness even when processed at a high draft ratio, and that is suitable for obtaining soft feel sanitary products.

Means for Solving Problem

The present invention relates to an elastic fiber treatment agent, containing: a hydrocarbon resin (A); and a hydrocarbon oil (B). The hydrocarbon resin (A) contains a polymer having a structural unit, as a main structural unit, derived from at least one monomer selected from aromatic olefin and aliphatic diolefin, the polymer being partially hydrogenated or fully hydrogenated.

Effect of the Invention

The present invention provides an elastic fiber treatment agent that imparts stable unraveling properties to elastic fibers and has good adhesiveness to a hot melt adhesive when a hot melt adhesive is used. Because the elastic fiber treatment agent does not impair the stretch characteristics of elastic fibers, a stretchable sheet is obtained that is stretchable with low stress and that exhibit good adhesiveness even when elastic fibers are processed at a high draft ratio. Sanitary products such as disposable diapers and sanitary napkins can be produced without yarn breakage even when the production speed is increased, and the cost can be reduced by reducing the amount of the hot melt adhesive. The hot melt adhesive retention rate can be an indicator of adhesiveness. Sanitary products containing less hot melt adhesive can reduce the hardening of members due to the hot melt adhesive and have softer texture, thereby providing excellent comfort and excellent fit.

DESCRIPTION OF THE INVENTION

Figure 1:
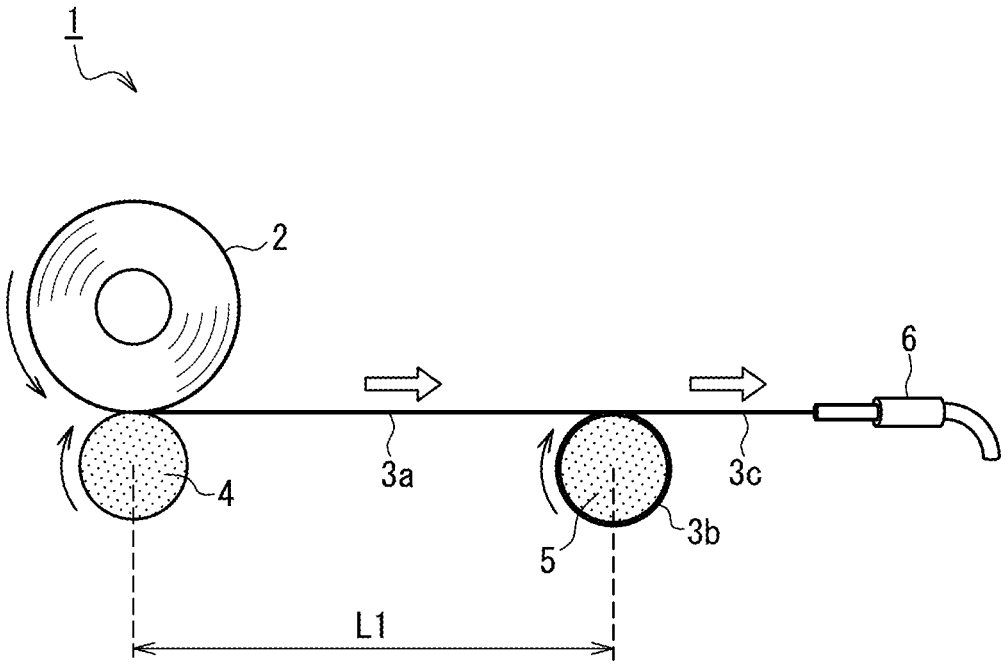
FIG. 1 is a schematic diagram of an elastic fiber unraveling stability tester used in examples of the present invention.

A hydrocarbon resin (A) according to the present invention is not particularly limited as long as it contains a polymer having a structural unit as a main structural unit derived from at least one monomer selected from aromatic olefin and aliphatic diolefin, the polymer being partially hydrogenated (also referred to as partial hydrogenation) or fully hydrogenated (also referred to as full hydrogenation). The partial hydrogenation according to the present invention means that 50% or more and less than 100% of double bonds in the polymer are hydrogenated. When the term "hydrogenation" is used alone, it covers a combined range of partial hydrogenation and full hydrogenation. In the present specification, the "polymer having a structural unit as a main structural unit derived from at least one monomer selected from aromatic olefin and aliphatic diolefin" is also referred to as a "hydrocarbon resin precursor polymer". Usually, the "hydrocarbon resin precursor polymer" and the "hydrocarbon resin (A)" are simply called "petroleum resin" and often not distinguished, but the present invention distinguishes them as above according to the structure. The fully hydrogenated "hydrocarbon resin (A)" is sometimes called a saturated hydrocarbon resin. Because the hydrocarbon resin (A) may have different types of structural units and may have a partially hydrogenated structure, it is difficult to accurately express the structure using a chemical name. For the sake of convenience, the following specifies monomers that constitute a polymer before hydrogenation. In other words, when a monomer is described, the structure derived from the monomer is specified, and the raw materials are not limited. In the present invention, the "main structural unit" is a structural unit derived from at least one monomer selected from aromatic olefin and aliphatic diolefin and constituting 90 mass % or more of the polymer.

In the present invention, it is preferred that the hydrocarbon resin (A) contains a polymer having a structural unit derived from aromatic olefin as a monomer, the polymer being partially hydrogenated or fully hydrogenated, and the aromatic olefin is at least one of indene or methylstyrene. With this configuration, it is possible to provide an elastic fiber treatment agent that imparts further improved unraveling properties to elastic fibers and has good adhesiveness to hot melt adhesives.

It is also preferred that the hydrocarbon resin (A) contains a polymer having a structural unit derived from aliphatic diolefin as a monomer, the polymer being partially hydrogenated or fully hydrogenated, and the aliphatic diolefin is isoprene (including optical isomers).

It is preferred that the hydrocarbon resin (A) has a softening point of 70° C. to 140° C. With this configuration, the hydrocarbon resin (A) softens by heat below the bonding temperature of hot melt adhesives, thereby producing an elastic fiber treatment agent having good adhesiveness to hot melt adhesives.

The elastic fiber treatment agent contains the hydrocarbon resin (A) in an amount of preferably 0.1 to 40 mass %, more preferably 1 to 20 mass %, and further preferably 3 to 10 mass %, with respect to 100 mass % of the elastic fiber treatment agent. This improves the affinity with hot melt adhesives.

It is preferred that 10 mass % or more of the hydrocarbon resin (A) dissolves in the hydrocarbon oil (B) at 20° C., and the hydrocarbon resin (A) is insoluble in at least one of N,N-dimethylacetamide (DMAc) or N,N-dimethylformamide (DMF).

The swelling rate of polyurethane when the treatment agent is adhered to polyurethane is preferably 2.5% or less, more preferably 2.2% or less, and further preferably 2.0% or less. This prevents the polyurethane elastic fibers from being impregnated with the hydrocarbon oil and stably keeps the fiber shape.

Examples of petroleum resins serving as the hydrocarbon resin precursor polymer and the hydrocarbon resin (A) include "C9 petroleum resins" mainly containing aromatic olefin as a monomer, "C5 petroleum resins" mainly containing aliphatic diolefin as a monomer, and "C5/C9 petroleum resins" that are a mixture of these. Here, "mainly containing aromatic olefin as a monomer" means that structural units derived from aromatic olefin constitute more than 50 mol % of the whole including structural units derived from other monomers. Similarly, "mainly containing aliphatic diolefin as a monomer" means that structural units derived from aliphatic diolefin constitute more than 50 mol % of the whole including structural units derived from other monomers.

The monomers that constitute the structural units of C9 petroleum resins (also referred to as C9 petroleum resin monomers) are mainly alkylbenzene and aromatic olefin. Examples of the alkylbenzene include isopropylbenzene, n-propylbenzene, 1-methyl-2-ethylbenzene, 1-methyl-3-ethylbenzene, 1-methyl-4-ethylbenzene, 1,3,5-trimethylbenzene, 1,2,3-trimethylbenzene, 1,2,4-trimethylbenzene, 1-methyl-2-n-propylbenzene, 1-methyl-3-n-propylbenzene, 1-methyl-4-isopropylbenzene, 1,3-diethylbenzene, and 1,4-diethylbenzene.

Examples of the aromatic olefin include α-methylstyrene, β-methylstyrene, o-methylstyrene, m-methylstyrene, p-methylstyrene, indene, m-methylpropenylbenzene, m-methylisopropenylbenzene, p-methylisopropenylbenzene, o-ethylstyrene, m-ethylstyrene, p-ethylstyrene, m,m-dimethylstyrene, dimethyl styrene, and methyl indene. A hydrocarbon resin precursor polymer or hydrocarbon resin (A) containing a C9 petroleum resin according to the present invention preferably contains indene and methylstyrene as monomers.

Examples of the monomers that constitute the structural units of C5 petroleum resins (also referred to as C5 petroleum resin monomers) include 1-pentene, 2-pentene, 2-methyl-1-butene, 2-methyl-2-butene, cyclopentene, 1,3-pentadiene, isoprene, cyclopentadiene, and dicyclopentadiene. A hydrocarbon resin precursor polymer or hydrocarbon resin (A) containing a C5 petroleum resin according to the present invention preferably contains isoprene as a monomer.

A treatment agent containing such a hydrocarbon resin (A) particularly improves the hot melt adhesiveness of elastic fibers. Hydrogenated petroleum resins (C5 petroleum resins and C9 petroleum resins) have excellent compatibility with the hydrocarbon oil of the present invention and can be stably applied to elastic fibers.

The hydrocarbon resin (A) of the present invention preferably has a softening point ranging from 70° C. to 140° C. to improve the adhesiveness to hot melt adhesives. A hydrocarbon resin (A) having a softening point of 70° C. or higher further improves the maintainability of adhesion force with hot melt adhesives under high temperature environments after curing of hot melt adhesives and improves creep resistance. A hydrocarbon resin (A) having a softening point of 140° C. or lower is highly compatible with the hydrocarbon oil (B) during the production process described below and can be dissolved in the hydrocarbon oil (B) at a high concentration, thereby facilitating the preparation of the treatment agent.

The softening point of the hydrocarbon resin (A) is measured according to JIS K2207:2006.

As the hydrocarbon resin (A), commercially available hydrogenated petroleum resin products and commercially available saturated hydrocarbon resin products can be used. Examples thereof include products composed of the following structural components and having a softening point of 70° C. to 140° C.

- Partially hydrogenated petroleum hydrocarbon resin of a copolymerized petroleum resin containing aliphatic and aromatic components
- Fully hydrogenated petroleum hydrocarbon resin of a copolymerized petroleum resin containing aliphatic and aromatic components
- Fully hydrogenated petroleum hydrocarbon resin of an aliphatic petroleum hydrocarbon resin
- Partially hydrogenated petroleum hydrocarbon resin of an aromatic petroleum hydrocarbon resin
- Fully hydrogenated petroleum hydrocarbon resin of an aromatic petroleum hydrocarbon resin In the present invention, it is preferred that 10 mass % or more of the hydrocarbon resin (A) dissolves in the hydrocarbon oil (B) at 20° C. The hydrocarbon resin (A) having this solubility facilitates the preparation of the treatment agent and enables the production of elastic fibers having excellent hot melt adhesiveness and unraveling properties.

The hydrocarbon resin (A) having a solubility in the hydrocarbon oil (B) of 10 mass % or more at 20° C. further improves the affinity with hot melt adhesives.

The hydrocarbon oil (B) according to the present invention is not particularly limited as long as the proportion of hydrocarbons with 6 to 60 carbon atoms is 90% or more and it has fluidity at 30° C. The chemical structure may be either linear or branched. The hydrocarbon oil (B) may contain some hydroxyl groups within a range that does not impair its hydrophobicity. Among these, the hydrocarbon oil (B) is preferably a mineral oil, from the viewpoint of availability and cost.

Examples of the mineral oil include aromatic hydrocarbons, paraffinic hydrocarbons, and naphthenic hydrocarbons. These may be used alone or in combination of two or more. The viscosity of the mineral oil at 40° C. based on a Redwood viscometer is preferably 30 to 350 seconds, more preferably 35 to 200 seconds, and further preferably 40 to 150 seconds. The mineral oil is preferably a paraffinic hydrocarbon because it produces less odor.

The elastic fiber treatment agent of the present invention may further contain a silicone oil (c), a higher alcohol (d), and a metal soap (e), as necessary.

Although the silicone oil (c) is not particularly limited, preferable examples thereof include polydimethylsiloxanes having dimethylsiloxane units, polydialkylsiloxanes having dimethylsiloxane units and dialkylsiloxane units containing an alkyl group with 2 to 4 carbon atoms, and polysiloxanes having dimethylsiloxane units and methylphenylsiloxane units.

The silicone oil (c) preferably has a viscosity at 25° C. of $5\times10^{-6}$ to $50\times10^{-6}$ $m^2/s$, from the viewpoint of improving handleability and reducing running friction with guides. The viscosity may be measured by the method specified in JIS-K2283: "Crude petroleum and petroleum products—Determination of kinematic viscosity and calculation of viscosity index from kinematic viscosity".

The higher alcohol (d) is not particularly limited and may be linear and/or branched monoalcohols with 6 or more carbon atoms. Specific examples thereof include linear alcohols such as hexanol, heptanol, octanol, nonaol, decanol, undecanol, dodecanol, tridecanol, tetradecanol, pentadecanol, hexadecanol, heptadecanol, octadecanol, nonadecanol, eikosanol, heneikosanol, docosanol, tricosanol, tetracosanol, pentacosanol, hexacosanol, heptacosanol, octacosanol, nonacosanol, and triacosanol; branched alkanols such as isodecanol, isododecanol, isotetradecanol, isohexadecanol, isooctadecanol, isoeicosanol, isohenicosanol, isodocosanol, isotetracosanol, isohexacosanol, isooctacosanol, and isotriacosanol; linear alkenols such as hexenol, heptenol, octenol, nonenol, decenol, undecenol, dodecenol, tridecenol, tetradecenol, pentadecenol, hexadecenol, pentadecenol, hexadecenol, heptadecenol, octadecenol, nonadecenol, eisenol, docosenol, tetracosenol, pentacosenol, hexacosenol, heptacosenol, octacosenol, nonacosenol, and triaconsenol; and branched alkenols such as isohexenol, 2-ethylhexenol, isotridecenol, 1-methylheptadecenol, 1-hexylheptenol, isotridecenol, and isooctadecenol.

Specific examples of the metal soap (e) include metal salts (saponified substances) of fatty acids such as stearic acid, palmitic acid, myristic acid, eicosanoic acid, docosanoic acid, lauric acid, 12-hydroxystearic acid, arachidic acid, behenic acid, octanoic acid, and talloil fatty acid; and metal salts (saponified substances) of resin acids such as abietic acid, neoabietic acid, d-pimaric acid, iso-d-pimaric acid, podocarpic acid, agathendicarboxylic acid, benzoic acid, cinnamic acid, p-oxycinnamic acid, and diterpene acid.

The type of the metal constituting the metal salts is preferably a metal other than alkali metal. Examples thereof include aluminum, calcium, zinc, magnesium, silver, barium, beryllium, cadmium, cobalt, chromium, copper, iron, mercury, manganese, nickel, lead, tin, and titanium.

The metal soap (e) is particularly preferably magnesium stearate and calcium stearate.

It is preferred that the metal soap (e) is pulverized into an average particle diameter of 0.1 to 1.0 μm, from the viewpoint of improving handleability and preventing sedimentation in the treatment agent.

It is preferred that the contents of the silicone oil (c) and the metal soap (e) are determined appropriately according to the intended use.

The following describes the elastic fibers according to the present invention (hereinafter, referred to as the "elastic fibers of the present invention"). The elastic fibers of the present invention are elastic fibers to which the above-described treatment agent of the present invention is adhered. The amount of the treatment agent of the present invention adhering to elastic fibers is preferably, but not particularly limited to, 0.1 to 10 parts by mass, and more preferably 0.1 to 3 parts by mass with respect to 100 parts by mass of the elastic fibers.

Examples of the elastic fibers include polyester-based elastic fibers, polyamide-based elastic fibers, polyolefin-based elastic fibers, and polyurethane-based elastic fibers. Among these, polyurethane-based elastic fibers are preferred.

Next, the production method of polyurethane elastic fibers suitably used as the elastic fibers of the present invention will be detailed.

In the present invention, a method for producing a spinning solution containing polyurethane (hereinafter, also referred to as a "polyurethane spinning solution") or a method for producing polyurethane (a solute of the solution) may be either melt polymerization or solution polymerization, or other methods. Among these, solution polymerization is preferred, because solution polymerization produces less foreign substances such as gel in polyurethane and facilitates spinning and production of fine polyurethane elastic fibers. Needless to say, solution polymerization is advantageous in that it can omit a step of making a solution.

A polyurethane particularly suitable for the present invention contains polytetramethylene glycol (PTMG) having a molecular weight of 1500 to 6000 as a polymer diol, diphenylmethane diisocyanate (MDI) as a diisocyanate, and at least one of diamine or diol (hereinafter simply described "diamine and/or diol") as a chain extender. Preferable examples of the diamine chain extender to form polyurethane urea include ethylenediamine, 1,3-cyclohexanediamine, and 1,4-cyclohexanediamine. Preferable examples of the diol include ethylene glycol, 1,3-propanediol, 1,4-butanediol, neopentyl glycol, 1,2-propylene glycol, 1,4-cyclohexanedimethanol, 1,4-cyclohexanediol, 1,4-bis (β-hydroxyethoxy) benzene, bis (β-hydroxyethyl) terephthalate, and paraxylylenediol. The chain extender is not limited to one type of diamine and/or diol and may be two or more kinds of diamines and/or diols. The melting point of yarns produced from polyurethane on the high temperature side preferably ranges from 200° C. to 280° C.

Polyurethane can be obtained, for example, by synthesizing the above-described raw materials in a solvent such as DMAc, DMF, dimethyl sulfoxide (DMSO), N-methyl-2-pyrrolidone (NMP), or a solvent mainly containing any of these. For example, particularly suitable methods are a one-shot method in which raw materials are dissolved in such a solvent and heated to a suitable temperature for reaction to obtain a polyurethane; and a method in which a polymer diol and a diisocyanate are melted and reacted, and then a reaction product is dissolved in a solvent and reacted with diamine and/or diol to obtain a polyurethane.

A typical method for adjusting the melting point of the polyurethane on the high temperature side to a range from 200° C. to 280° C. is to control the type and the proportion of the polymer diol, MDI, and diamine and/or diol. When the polymer diol has a low molecular weight, the relative proportion of the MDI is increased to produce a polyurethane with a raised melting point on the high temperature side. Similarly, when the diamine and/or diol have a low molecular weight, the relative proportion of the polymer diol is reduced to produce a polyurethane with a raised melting point on the high temperature side.

When the molecular weight of the polymer diol is 1800 or more, it is preferable for the polymerization to proceed at a proportion of (the number of moles of MDI)/(the number of moles of polymer diol) of 1.5 or more to raise the melting point on the high temperature side to 200° C. or higher.

It is also preferred that the elastic fibers of the present invention contain one kind or two or more kinds of end-capping agents. Preferable examples of the end-capping agent include monoamines such as dimethylamine, diisopropylamine, ethyl methylamine, diethylamine, methyl propylamine, isopropyl methylamine, diisopropylamine, butyl methylamine, isobutyl methylamine, isopentyl methylamine, dibutylamine, and diamylamine; monools such as ethanol, propanol, butanol, isopropanol, allyl alcohol, and cyclopentanol; and monoisocyanates such as phenylisocyanate.

The polyurethane elastic fibers of the present invention may further contain various additives such as stabilizers and pigments. Preferable examples thereof include the following: light resistance agents and antioxidants including hindered phenol-based chemical agents such as BHT and "SUMILIZER-GA-80" manufactured by Sumitomo Chemical Co., Ltd., benzotriazole-based chemical agents such as "TINUVIN" of various types manufactured by Ciba-Geigy Corporation, benzophenone-based chemical agents, phosphorus-based chemical agents such as "SUMILIZER P-16" manufactured by Sumitomo Chemical Co., Ltd., and hindered amine-based chemical agents; pigments such as iron oxide and titanium oxide; inorganic materials such as zinc oxide, cerium oxide, magnesium oxide, calcium carbonate, and carbon black; fluorine-based and silicone-based resin powders; metal soaps such as magnesium stearate; germicides containing silver, zinc or compounds thereof deodorants; and antistatic agents such as barium sulfate, cerium oxide, betaine and phosphoric acid-based agents. It is also preferred that these are reacted with polymer. To further increase durability especially against light and nitrogen oxides, it is preferable to use, for example, a nitrogen oxide scavenger such as HN-150 manufactured by Japan Hydrazine Co., Ltd., a thermal oxidation stabilizer such as "SUMILIZER GA-80" manufactured by Sumitomo Chemical Co., Ltd., and a light stabilizer such as "SUMISORB 300 #622" manufactured by Sumitomo Chemical Co., Ltd.

Usually, the polyurethane spinning solution thus obtained preferably has a concentration ranging from 30 to 80 mass %.

The polyurethane elastic fibers of the present invention can be obtained, for example, by subjecting the spinning solution to dry spinning, wet spinning, or melt spinning, and taking up fibers. Among them, dry spinning is preferred from the viewpoint of stably spinning any fineness from thin to thick.

The fineness and the cross-sectional shape of the polyurethane elastic fibers of the present invention are not particularly limited. For example, the fibers may have a circular cross section or an elliptical cross section.

The dry spinning method is also not particularly limited, and spinning conditions may be appropriately selected depending on desired characteristics and spinning facilities.

The permanent deformation rate and the stress relaxation of the polyurethane elastic fibers of the present invention are easily influenced by a speed ratio between a godet roller and a taking-up machine, and therefore it is preferable to appropriately determine the speed ratio based on the intended use of the yarns.

The speed ratio for taking-up between the godet roller and the taking-up machine preferably ranges from 1.10 to 1.65, from the viewpoint of obtaining polyurethane elastic fibers with a desired permanent deformation rate and a desired stress relaxation. Specifically, to obtain polyurethane elastic fibers with a low permanent deformation rate and a low stress relaxation, the speed ratio between the godet roller and the taking-up machine preferably ranges from 1.15 to 1.4 and more preferably ranges from 1.15 to 1.35. To obtain polyurethane elastic fibers with a high permanent deformation rate and a high stress relaxation, the speed ratio for taking-up between the godet roller and the taking-up machine preferably ranges from 1.25 to 1.65 and more preferably ranges from 1.35 to 1.65.

The spinning speed is preferably 300 m/min or more, from the viewpoint of improving the strength of the resultant polyurethane elastic fibers.

The treatment agent of the present invention is adhered to elastic fibers through neat oil supply, in which the treatment agent is supplied without being diluted with a solvent or the like. The adhering step can be performed in any step such as a step after spinning and until fibers are taken up into a package, a step of rewinding the taken-up package, or a step of warping with a warping machine. The adhering method may be a known method such as the roller supply method, guide supply method, or spray supply method. The amount of the treatment agent adhering to the elastic fibers ranges from 0.1 to 5 parts by mass and preferably ranges from 0.1 to 3 parts by mass with respect to 100 parts by mass of the elastic fibers, from the viewpoint of balancing the hot melt adhesiveness and the unraveling properties. It is preferred that the treatment agent of the present invention is applied as a spinning oil agent immediately after spinning of the elastic fibers.

The hot melt adhesive to be used preferably adheres at temperatures ranging from 120° C. to 180° C. Examples of the polymer materials of the hot melt adhesive include hydrogenated SBS (styrene-butadiene-styrene block copolymer), ethylene vinyl acetate (EVA), polyolefin copolymers, synthetic rubber-based hot melt materials, polyamide-based hot melt materials, polyester-based hot melt materials, and polyurethane-based hot melt materials.

Figure 2A:
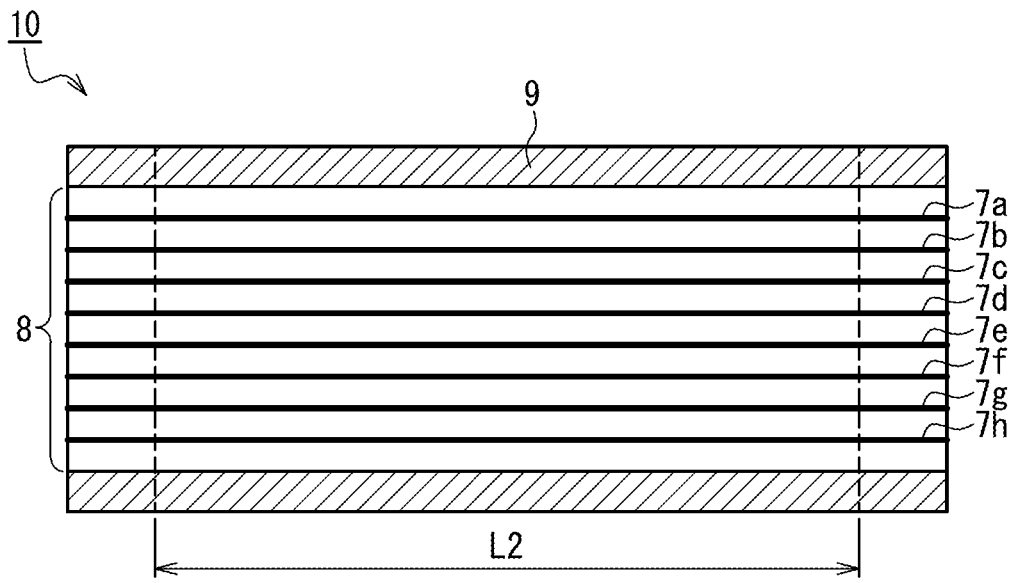
FIG. 2A and FIG. 2B are schematic diagrams illustrating a method for testing hot melt adhesiveness.
Figure 2B:
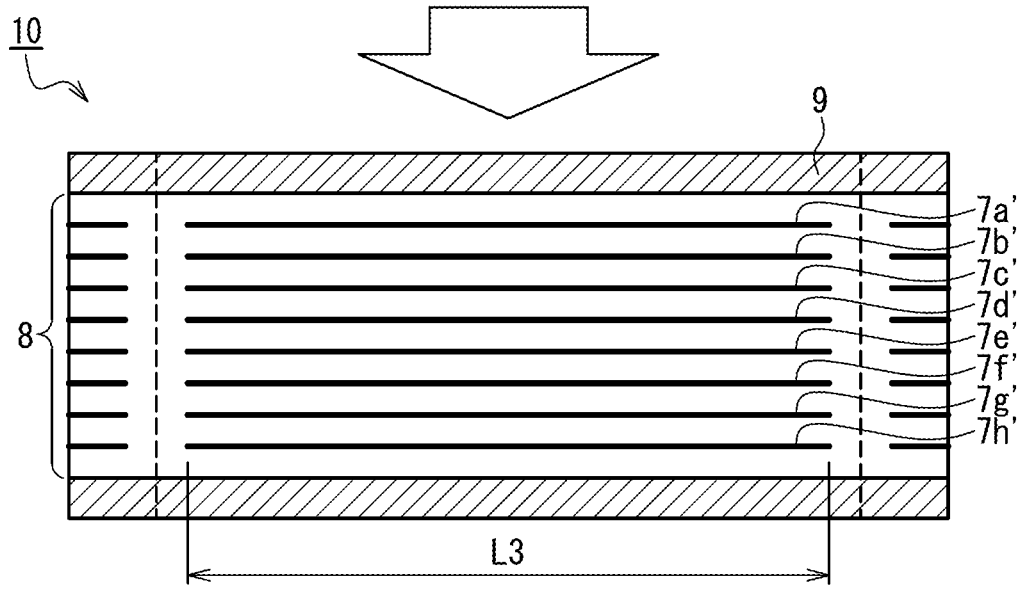

FIG. 1 is a schematic diagram of an elastic fiber unraveling stability tester used in the examples of the present invention. FIG. 2A and FIG. 2B are schematic diagrams illustrating a method for testing the hot melt adhesiveness. The details will be described in the examples.

EXAMPLES

Hereinafter, the present invention will be described in more detail by way of examples. However, the present invention is not limited to the following aspects. First, methods for evaluating various properties in the present invention will be explained.

[Kinematic Viscosity of Treatment Agent]

The kinematic viscosity (unit: $mm^2/s$) of the treatment agent at 30° C. was measured according to JIS K 2283-2000 with a Canon-Fenske viscometer.

[Swelling Rate of Treatment Agent]

Commercially available polyurethane films were cut into 6 cm×10 cm, weighed precisely, and immersed in a corresponding oil agent for 7 minutes. Then, the oil agent adhering to the film surface was wiped off, and the film was weighed. A weight increase rate of the film was determined as a swelling rate.

[Stability of Treatment Agent with respect to Polyurethane]

The elastic fiber treatment agent was left to stand at 25° C. for three months to evaluate the stability of the treatment agent according to the following criteria.

A (Excellent): There was no precipitation or separation, and the initial uniform state was maintained.

B (Good): Very slight moisture and precipitation occurred, but the initial uniform state was restored by stirring.

C (Poor): Precipitation and separation occurred, and the initial uniform state was not restored by stirring.

[Unraveling Stability Test of Polyurethane Elastic Fibers]

A 4.5 kg yarn roll of polyurethane elastic fibers was left for stand in an atmosphere of 35° C. and 65% relative humidity (RH) for 14 days, and then tested using an unraveling stability tester shown in FIG. 1. The unraveling stability tester 1 includes a yarn roll 2, textured rollers 4, 5, and an aspirator 6. The surface of the yarn roll 2 was placed in contact with the textured roller 4. A polyurethane elastic fiber 3*a* was fed while the textured roller 4 was rotated at a constant surface speed of 30 m/min (SI). Then, the polyurethane elastic fiber 3*a* was made to run around one lap of a textured roller 5 of the same diameter located at a distance of LI=100 cm from the textured roller 4 (polyurethane elastic fiber 3*b*). A minimum speed (S2) of the textured roller 5, at which the polyurethane elastic fiber 3*a* released from the textured roller 4 was fed smoothly without being lifted by the yarn roll 2, was determined by gradually changing the surface speed of the textured roller 5. The unraveling properties of the polyurethane elastic fiber 3*a* was determined based on the speed ratio (S2)/(S1) of the textured rollers 4 and 5. The portion of the 4.5 kg yarn roll 1 cm from the outside was measured as outer layer unraveling properties (A), the portion 1 cm from the inside was measured as inner layer unraveling properties (B) to determine the unraveling stability (B)-(A) according to the wound layers. The polyurethane elastic fiber 3*c* having passed through the textured roller 5 was suctioned by the aspirator 6.

The smaller value of the unraveling stability (B)-(A) indicates higher stability in the separation of the polyurethane elastic fibers between layers.

The unraveling properties test was performed using two yarn rolls, and the average value was evaluated.

[Hot Melt Adhesiveness Test]

Eight polyurethane elastic fibers were stretched to a specified draft ratio of 3.0 while running in one direction at equal intervals, over a 15-cm-wide polypropylene non-woven fabric running at a speed of 130 m/minute. A hot melt adhesive mainly containing an SBS (styrene-butadiene-styrene) block copolymer, dissolved in a pot at 150° C., was applied to the polyurethane elastic fibers in a specified amount of 0.05 g/m per polyurethane elastic fiber using a comb gun. Then, another thin transparent polypropylene non-woven fabric was placed from the above, followed by pressure bonding, and taken-up to obtain a stretchable sheet.

As illustrated in FIG. 2A and FIG. 2B, the obtained stretchable sheet 8 was fixed to a flat wooden plate 9, with the non-woven fabrics (not illustrated) being fully stretched. The eight polyurethane elastic fibers 7*a*-7*h* interposed between the non-woven fabrics were cut at both ends (16 locations in total) into a length (L2) of 30 cm from the above of the stretchable sheet 8 using a razor blade. A stretching plate 10 was stored at 40° C. and 80% RH, and a length (L3) of the polyurethane elastic fibers 7*a*-7*h*, fixed with the hot melt adhesive, after they shrank back, i.e., slipped into the polypropylene non-woven fabrics was measured after two-hour storage and eight-hour storage. The measured lengths (L3) were compared with the original length (L2). A total of 24 elastic fibers was measured, and the average value of the hot melt adhesive retention rates of the 24 fibers was evaluated.

Hot melt adhesiveness retention rate (%)=100×(L3)/(L2)

The higher hot melt adhesiveness retention rate is better.

[Preparation of Treating Agent]

The components for the treatment agents A1 to A10 and B1 to B6 were blended in the respective proportions as indicated in Table 1. At this time, the treatment agents containing a hydrocarbon resin were prepared by stirring at 40° C. for complete dissolution. The treatment agents containing a metal soap component were prepared by dispersion using a ball mill.

[Hydrocarbon Resin (A)]

The following hydrocarbon resins (A) were used.

a-1: Fully hydrogenated petroleum hydrocarbon resin of an aromatic petroleum hydrocarbon resin, the structural components including indene and methylstyrene as starting materials, softening point: 90° C.

a-2: Fully hydrogenated petroleum hydrocarbon resin of a copolymerized petroleum resin of aliphatic and aromatic components, the structural components including dicyclopentadiene, indene, and methylstyrene as starting materials, softening point: 99° C.

a-3: Partially hydrogenated petroleum hydrocarbon resin of an aromatic petroleum hydrocarbon resin, the structural components including indene and methylstyrene as starting materials, softening point: 135° C.

[Hydrocarbon Oil (B)]

Liquid paraffin was used as the hydrocarbon oil (B), and the number of seconds required for 50 ml of the sample to flow down was measured at 40° C. using a Redwood viscometer No. 827 manufactured by YOSHIDA SEISAKUSHO CO., LTD.

[Silicone Oil (c)]

Polydimethylsiloxane having a kinematic viscosity at 25° C. of $20\times10^{-6}$ $m^2/s$ measured according to JIS Z 8803-2011 with a Canon-Fenske viscometer was used.

[Higher Alcohol (d)]

Isohexadecanol was used. [Metallic Soap (e)]

Magnesium stearate was used. The treatment agent was wet pulverized to adjust the average particle diameter of the magnesium stearate to 0.4 to 0.6 μm. A laser diffraction/scattering particle size distribution analyzer was used to determine the average particle diameter using the median diameter based on the number.

TABLE 1

| | Treatment agent | Hydrocarbon resin (A) Softening point: 90° C. a-1 | Softening point: 99° C. a-2 | Softening point: 135° C. a-3 | Hydrocarbon oil (B) Viscosity: 200 sec. (40° C.) | Viscosity: 100 sec. (40° C.) | Viscosity: 80 sec. (40° C.) |
|---|---|---|---|---|---|---|---|
| Ex. 1 | A1 | 5 | 0 | 0 | 0 | 95 | 0 |
| Ex. 2 | A2 | 5 | 0 | 0 | 0 | 0 | 95 |
| Ex. 3 | A3 | 0 | 5 | 0 | 0 | 95 | 0 |
| Ex. 4 | A4 | 0 | 0 | 5 | 0 | 95 | 0 |
| Ex. 5 | A5 | 10 | 0 | 0 | 0 | 0 | 90 |
| Ex. 6 | A6 | 10 | 0 | 0 | 0 | 0 | 75 |
| Ex. 7 | A7 | 0 | 0 | 10 | 0 | 59 | 0 |
| Ex. 8 | A8 | 20 | 0 | 0 | 0 | 0 | 70 |
| Ex. 9 | A9 | 0 | 5 | 0 | 0 | 0 | 94 |
| Ex. 10 | A10 | 5 | 0 | 0 | 0 | 65 | 0 |
| Comp. Ex. 1 | B1 | 0 | 0 | 0 | 0 | 100 | 0 |
| Comp. Ex. 2 | B2 | 0 | 0 | 0 | 0 | 0 | 100 |
| Comp. Ex. 3 | B3 | 0 | 0 | 0 | 0 | 0 | 85 |
| Comp. Ex. 4 | B4 | 0 | 0 | 0 | 0 | 70 | 0 |
| Comp. Ex. 5 | B5 | 0 | 0 | 0 | 0 | 69 | 0 |
| Comp. Ex. 6 | B6 | 0 | 0 | 0 | 85 | 0 | 0 |

| | Silicone oil (c) Amount in treatment agent (mass %) | Higher alcohol (d) Amount in treatment agent (mass %) | Metal soap (e) Amount in treatment agent (mass %) | Evaluation of treatment agent Kinematic viscosity 30° C. $mm^2/s$ | Swelling rate (%) | Stability |
|---|---|---|---|---|---|---|
| Ex. 1 | 0 | 0 | 0 | 21 | 2.0 | A |
| Ex. 2 | 0 | 0 | 0 | 18 | 2.1 | A |
| Ex. 3 | 0 | 0 | 0 | 22 | 2.0 | A |
| Ex. 4 | 0 | 0 | 0 | 23 | 2.0 | A |
| Ex. 5 | 0 | 0 | 0 | 23 | 1.9 | A |
| Ex. 6 | 15 | 0 | 0 | 19 | 1.8 | A |
| Ex. 7 | 15 | 15 | 1 | 27 | 2.0 | B |
| Ex. 8 | 5 | 5 | 0 | 31 | 1.9 | A |
| Ex. 9 | 0 | 0 | 1 | 22 | 1.6 | B |
| Ex. 10 | 15 | 15 | 0 | 23 | 1.9 | A |
| Comp. Ex. 1 | 0 | 0 | 0 | 18 | 3.0 | A |
| Comp. Ex. 2 | 0 | 0 | 0 | 15 | 2.9 | A |
| Comp. Ex. 3 | 15 | 0 | 0 | 13 | 2.8 | A |
| Comp. Ex. 4 | 15 | 15 | 0 | 17 | 2.7 | A |
| Comp. Ex. 5 | 15 | 15 | 1 | 17 | 2.6 | B |
| Comp. Ex. 6 | 15 | 0 | 0 | 26 | 3.4 | A |

* Ex.: Example, Comp. Ex.: Comparative Example

Example 1

MDI and PTMG having a number-average molecular weight of 1800 were placed in a container at a molar ratio of MDI/PTMG=1.58/1 and reacted at 90° C., and the resultant reaction product was dissolved in N,N-dimethylacetamide (DMAc). Next, a DMAc solution containing ethylenediamine and diethylamine was added to the solution in which the reaction product was dissolved to prepare a polyurethane urea solution having a polymer solid content of 35 mass %.

A condensation polymer of p-cresol and divinylbenzene ("Methacrol" (registered trademark) 2390 manufactured by DuPont) as an antioxidant, and 2-[4,6-bis(2,4-dimethylphenyl)-1,3,5-triazin-2-yl]-5-(octyloxy)phenol ("CYASORB" (registered trademark) 1164 manufactured by Cytech Industries Inc.) as an ultraviolet absorber were mixed at a mass ratio of 3/2 to prepare a DMAc solution (concentration: 35 mass %) as an additive solution (35 mass %).

The polyurethane urea solution and the additive solution were mixed at a ratio of 98 mass % to 2 mass % to prepare a polyurethane spinning solution (X1).

This spinning solution (X1) was dry-spun at a taking-up speed of 500 m/min, and 1.5 parts by mass of the treatment agent A1 was applied with respect to 100 parts by mass of polyurethane elastic fibers during taking-up to produce polyurethane elastic fibers (580 decitex, 56 filaments) and thus obtain a 4.5 kg yarn roll.

Examples 2 to 10, Comparative Examples 1 to 6

4.5 kg yarn rolls of polyurethane elastic fibers of Examples 2 to 10 and Comparative Examples 1 to 6 were obtained in the same manner as in Example 1 except that the type of the treatment agent was changed as indicated in Table 1.

Table 2 shows the various evaluation results of the obtained yarns. The polyurethane elastic fibers of Examples 1 to 10 exhibited satisfactory performance in all of the evaluations. The polyurethane elastic fibers of Comparative Examples 1 to 6 were not satisfactory in either unraveling stability or hot melt adhesiveness.

TABLE 2

| | | Elastic fibers to which 1.5 parts by mass of treatment agent was applied | | | | |
|---|---|---|---|---|---|---|
| | | Outer layer unraveling | Inner layer unraveling | | Hot melt adhesive retention rate (%) | |
| | Treatment agent | properties (A) (—) | properties (B) (—) | (B) − (A) (—) | After 2 hours | After 8 hours |
| Ex. 1 | A1 | 1.40 | 2.01 | 0.61 | 94 | 92 |
| Ex. 2 | A2 | 1.31 | 2.04 | 0.73 | 96 | 93 |
| Ex. 3 | A3 | 1.38 | 2.00 | 0.62 | 93 | 92 |
| Ex. 4 | A4 | 1.35 | 1.99 | 0.64 | 95 | 92 |
| Ex. 5 | A5 | 1.42 | 1.97 | 0.55 | 96 | 94 |
| Ex. 6 | A6 | 1.31 | 1.93 | 0.62 | 94 | 90 |
| Ex. 7 | A7 | 1.43 | 1.99 | 0.56 | 95 | 89 |
| Ex. 8 | A8 | 1.33 | 1.95 | 0.62 | 96 | 94 |
| Ex. 9 | A9 | 1.24 | 1.83 | 0.59 | 93 | 90 |
| Ex. 10 | A10 | 1.27 | 1.98 | 0.71 | 94 | 91 |
| Comp. Ex. 1 | B1 | 1.21 | 2.30 | 1.09 | 91 | 83 |
| Comp. Ex. 2 | B2 | 1.19 | 2.27 | 1.08 | 91 | 84 |
| Comp. Ex. 3 | B3 | 1.07 | 2.23 | 1.16 | 89 | 76 |
| Comp. Ex. 4 | B4 | 1.19 | 2.21 | 1.02 | 88 | 77 |
| Comp. Ex. 5 | B5 | 1.15 | 2.16 | 1.01 | 88 | 74 |
| Comp. Ex. 6 | B6 | 1.42 | 2.46 | 1.04 | 78 | 65 |

* Ex.: Example, Comp. Ex.: Comparative Example

INDUSTRIAL APPLICABILITY

The elastic fiber treatment agent of the present invention imparts excellent unraveling properties to elastic fibers and has excellent adhesiveness to hot melt adhesives and thus is suitably used to impart excellent comfort and excellent fit to sanitary products such as disposable diapers and sanitary napkins.

DESCRIPTION OF REFERENCE NUMERALS

1 Unraveling stability tester
2 Yarn roll
3*a*, 3*b*, 3*c* Polyurethane elastic fibers
4, 5 Textured rollers
6 Aspirator
7*a*-7*h* Polyurethane elastic fibers before shrinkage
7*a*'-7*h*' Polyurethane elastic fibers after shrinkage
8 Stretchable sheet
9 Flat wooden plate

The invention claimed is:

1. An elastic fiber treatment agent, comprising:
a hydrocarbon resin (A); and
a hydrocarbon oil (B),
wherein the hydrocarbon resin (A) comprises a polymer having a structural unit, as a main structural unit, derived from at least one monomer selected from the group consisting of aromatic olefin and aliphatic diolefin, the polymer being partially hydrogenated or fully hydrogenated, and
wherein the elastic fiber treatment agent is a spinning oil agent having a kinematic viscosity at 30° C. of 18 to 31 $mm^2/s$ as measured according to JIS K 2283-2000.

2. The elastic fiber treatment agent according to claim 1, wherein the partially hydrogenated polymer is a polymer in which 50% or more and less than 100% of double bonds are hydrogenated.

3. The elastic fiber treatment agent according to claim 1, wherein the aromatic olefin is at least one compound selected from the group consisting of indene and methylstyrene.

4. The elastic fiber treatment agent according to claim 1, wherein the aliphatic diolefin is isoprene.

5. The elastic fiber treatment agent according to claim 1, wherein the hydrocarbon resin (A) has a softening point of 70° C. or higher and 140° C. or lower.

6. The elastic fiber treatment agent according to claim 1, wherein the elastic fiber treatment agent comprises the hydrocarbon resin (A) in an amount of 0.1 mass % or more and 40 mass % or less with respect to 100 mass % of the elastic fiber treatment agent.

7. The elastic fiber treatment agent according to claim 1, wherein 10 mass % or more of the hydrocarbon resin (A) dissolves in the hydrocarbon oil (B) at 20° C.

8. The elastic fiber treatment agent according to claim 1, wherein the hydrocarbon resin (A) is insoluble in at least one compound selected from the group consisting of N,N-dimethylacetamide (DMAc) or N,N-dimethylformamide (DMF).

9. The elastic fiber treatment agent according to claim 1, wherein the hydrocarbon oil (B) is a mineral oil.

* * * * *